United States Patent [19]

Schwartz

[11] Patent Number: 5,067,629

[45] Date of Patent: Nov. 26, 1991

[54] METHOD FOR DISPENSING DRINKING STRAWS AND A SUPPLY ARRANGEMENT THEREFOR

[76] Inventor: William K. Schwartz, 1160 Fifth Ave., Apt. 603, New York, N.Y. 10029-6928

[21] Appl. No.: 586,613

[22] Filed: Sep. 21, 1990

[51] Int. Cl.[5] ..... B65H 5/28

[52] U.S. Cl. ..... 221/70; 221/46; 221/71

[58] Field of Search ..... 221/26, 31, 32, 33, 221/46, 70, 71, 89, 287, 202, 312 C

[56] References Cited

U.S. PATENT DOCUMENTS

| | | | |
|---|---|---|---|
| 1,680,341 | 9/1926 | Rosenthal . | |
| 3,362,578 | 1/1968 | Spencer | 221/70 X |
| 3,780,944 | 12/1973 | Zubalik . | |
| 4,004,683 | 1/1977 | Pomeroy et al. | 221/70 X |
| 4,219,130 | 8/1980 | Wenkman et al. | 221/202 |
| 4,274,550 | 6/1981 | Feldstein | 221/71 |
| 4,550,857 | 11/1985 | Castner et al. | 221/70 |
| 4,718,573 | 1/1988 | Wenkman et al. | 221/202 |

*Primary Examiner*—Joseph E. Valenza
*Assistant Examiner*—Dean A. Reichard
*Attorney, Agent, or Firm*—Sprung Horn Kramer & Woods

[57] ABSTRACT

Drinking straws are efficiently packaged, shipped, stored and dispensed by providing a plurality of flexible, hollow, cylindrical tubes, each having a convenient length and cross-section for a drinking straw; arranging the tubes substantially in parallel; and pressing the tubes to force them into a substantially flattened configuration.

15 Claims, 3 Drawing Sheets

FIG.5
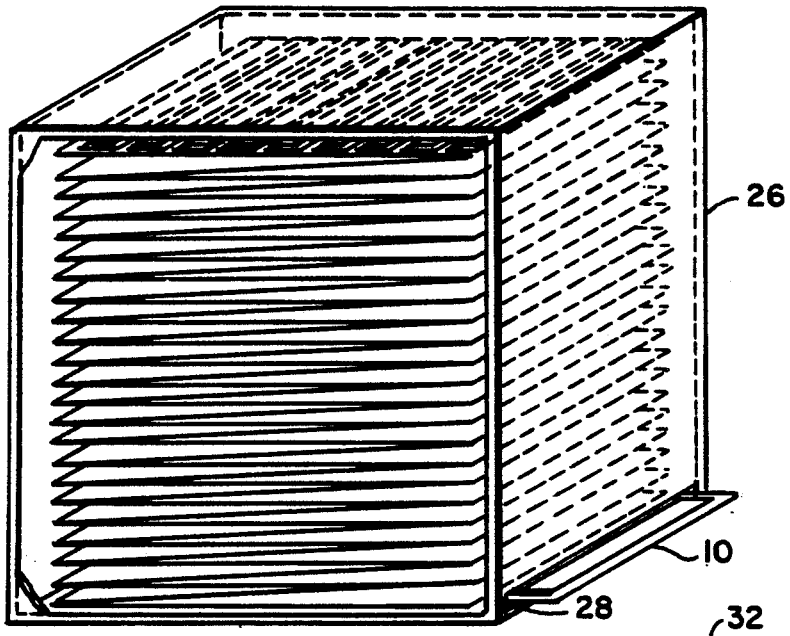
FIG.6
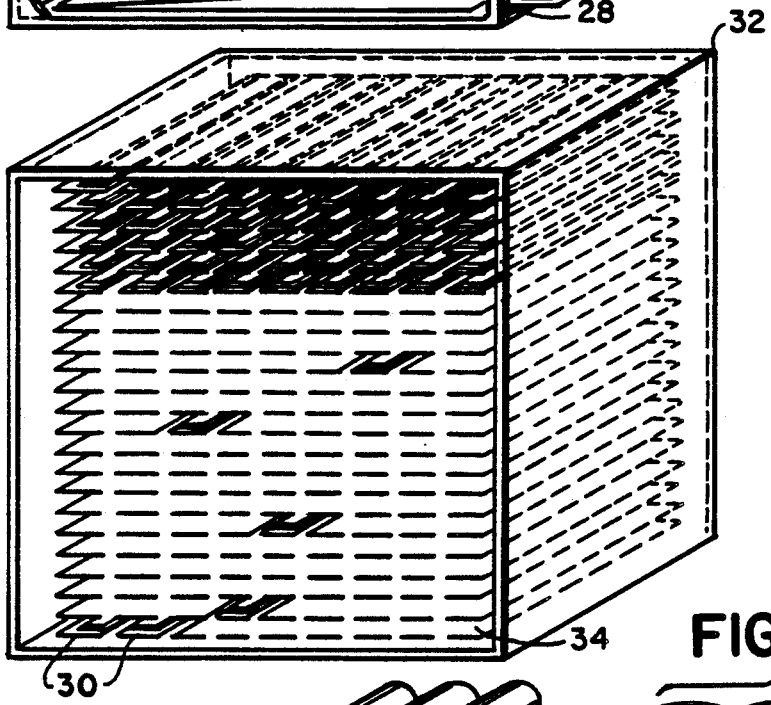
FIG.8a
FIG.8b
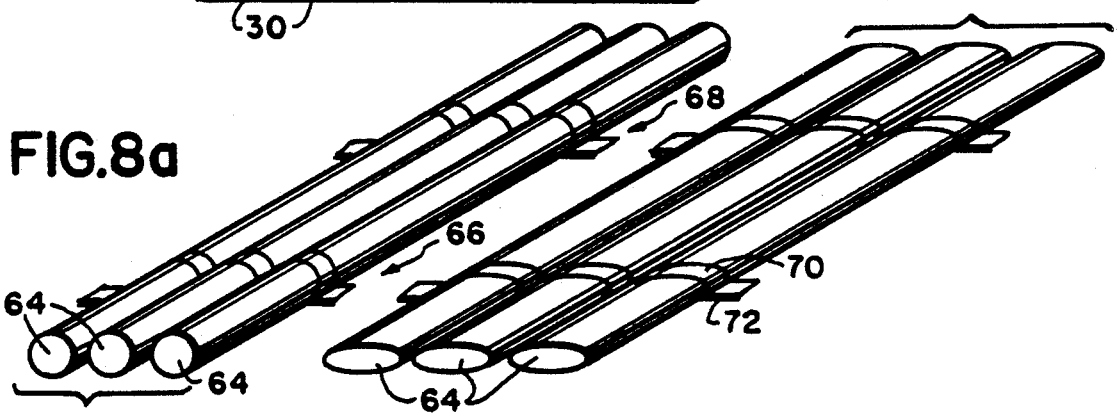

METHOD FOR DISPENSING DRINKING STRAWS AND A SUPPLY ARRANGEMENT THEREFOR

BACKGROUND OF THE INVENTION

The present invention relates to a method for dispensing drinking straws of various types. In addition, the invention relates to a drinking straw supply arrangement for use with the aforementioned method.

The drinking straw has become a familiar staple item in households and fast food restaurants throughout the world. Originally made from coated paper, drinking straws are now normally made of thin, flexible plastic. The plastic straws are manufactured by extruding an endless tube and then cutting the tube to a convenient (e.g., 7¾ inch) length, or by "rolling" a flat plastic strip into a cylinder and heat sealing the lateral edges together along a seam. The straws are then either loaded directly into boxes or first individually wrapped in paper sleeves before packing for shipment.

In some cases, straws have been modified, from this basic tubular structure, to permit special packaging arrangements. The U.S. Pat. No. 1,680,341 to Rosenthal discloses a flattened straw, cut to the usual 7¾ inch length, which is either rolled into a spiral form or folded back and forth a number of times to reduce its size. The resulting spirally wound or folded straw is then encapsulated in a bottle cap or other small package and attached to a bottle, can or carton.

The U.S. Pat. No. 3,780,944 also discloses a flattened drinking straw. During manufacture, a conventional round plastic straw is compacted and embossed between a pair of gears to facilitate its being folded a convenient number of times and fixed to a bottle, can or carton.

In the arrangements taught in both patents, an individual straw is dispensed with each bottle, can or carton. While this may be convenient for the consumer, it is an expensive solution to the straw dispensing problem.

More conventionally, in order to provide and dispense straws for use with soda cans or cups, for example, a plurality of tubular straws, cut to length, are supplied in a suitable container and dispensed, one by one, from the container by a suitable mechanical device or by hand. This method of dispensing straws is wasteful of space and requires frequent restocking of the dispensing device. Furthermore, since the volume occupied by a straw consists mostly of empty, unused space, this conventional method of dispensing straws creates inefficiencies in storage and shipping.

SUMMARY OF THE INVENTION

It is a principal object of the present invention to provide a method and a supply arrangement for dispensing drinking straws which require restocking of the dispensing device at less frequent intervals than the conventional methods and arrangements known in the art.

It is another object of the present invention to provide a method for dispensing drinking straws which facilitates use of a compact supply arrangement which contains an extremely large number of drinking straws.

It is a further object of the present invention to provide a supply arrangement and a drinking straw dispensing device which holds straw material in an especially compact form for shipping, storing and dispensing.

These objects, as well as further objects which will become apparent from the discussion that follows, are achieved, in accordance with the present invention, by:

(a) providing a plurality of flexible, hollow, cylindrical tubes, each tube having a convenient length and cross-section for a drinking straw;

(b) arranging said tubes substantially in parallel; and (c) pressing said tubes together to force them into a substantially flattened configuration, until needed.

The supply arrangement for use in dispensing drinking straws in accordance with the present invention comprises:

(a) a plurality of substantially flattened, flexible hollow tubes, each tube having a convenient length and cross-section for a drinking straw, with the tubes being arranged substantially in parallel; and (b) means for pressing the tubes to maintain their flattened configuration, until needed.

When cylindrical tubes of flexible material, particularly of plastic, are pressed into a flattened shape and thereafter released, they have a tendency to return to their original shape. To the extent that their shape memory is less than ideal, their shape can be restored by squeezing them laterally, either by hand or by a mechanical device.

Whether or not the tubes, as finally used as drinking straws, are restored to their original cylindrical shape, or whether they are used in a slightly out-of-round, oval shape, such tubes (straws) can function well as drinking straws.

Advantageously, the volume of a plurality of flattened straws is merely a small fraction of the volume of an equal number of conventional cylindrical straws. Since over 90% of the volume taken up by a conventional cylindrical straw is consumed by the air within the straw, the reduction in space required for the flattened straws according to the invention as compared to conventional straws is greater than a factor of ten.

There are several preferred embodiments of the supply arrangement according to the present invention:

First, the straws may be embedded in an endless web of flexible material which serves to connect the straws together and maintain their parallel arrangement. This flexible material may then be either spirally wound into a cylindrical shape or caused to zig-zag back and forth a large number of times. The resulting package is then packed tightly, for example by inserting it into a rigid container, to maintain the flattened configuration of the straws.

Alternatively, the straws may be packaged as separate, individual elements; i.e., without connecting them together by a web of material. The straws may, or may not be individually wrapped in a protective sheath. The flatness of the straws is maintained by the associated packaging material, for example the aforementioned rigid container.

Other objects and advantages of the present invention will become apparent from the following description of the preferred embodiments, taken in conjunction with the accompanying drawings.

BRIEF DESCRIPTION OF THE DRAWINGS

FIG. 5 is a perspective view, partially cut away, of a drinking straw supply cartridge in accordance with a second preferred embodiment of the present invention.

FIG. 6 is a perspective view of a drinking straw supply cartridge in accordance with a third preferred embodiment of the present invention.

FIG. 8*a* is a perspective view of a plurality of straws connected together by two separate flexible webs.

FIG. 8*b* is a perspective view of the arrangement of 8*a*, with the straws substantially flattened for shipping and dispensing.

DESCRIPTION OF THE PREFERRED EMBODIMENTS

The preferred embodiments of the present invention will now be described with reference to FIGS. 1–8 of the drawings.

Figure 1:
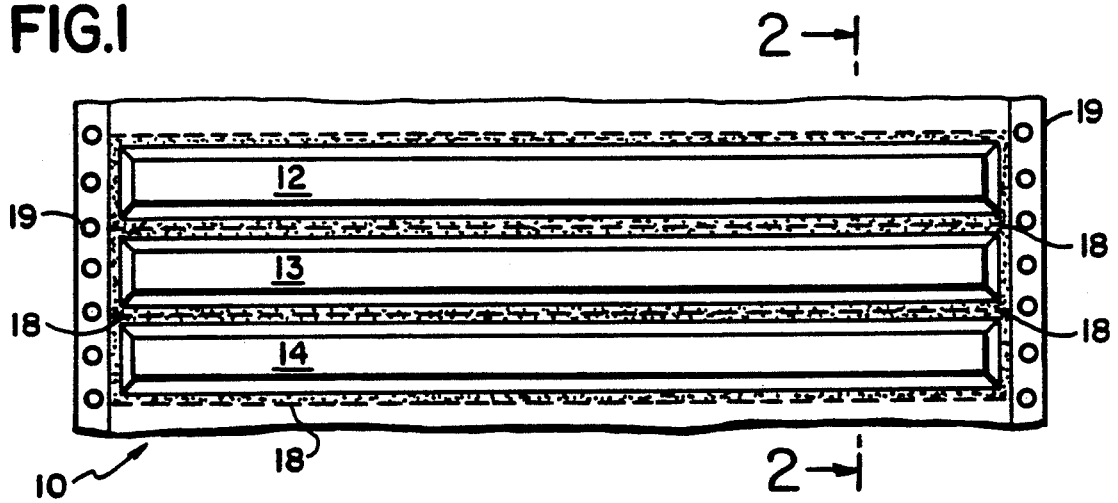
FIG. 1 is a top, plan view of a plurality of flattened straws connected together by a flexible web.
Figure 2:
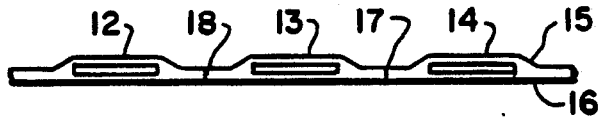
FIG. 2 is a cross-sectional diagram taken along the line 2—2 in FIG. 1.

FIGS. 1 and 2 show a flexible connecting web 10 which surrounds and supports a plurality of flattened straws 12, 13 and 14. The connecting web 10 is formed of two separate webs 15 and 16 disposed above and below the straws 12–14, respectively, to encase the straws. The two separate webs 15 and 16 which may be made of paper, plastic or other flexible web material, are attached together at the interstices 17 between the straws and at the ends of the straws. These webs may be attached by means of an adhesive, by crimping, heat sealing or any other known technique.

The connecting web 10 is perforated along lines 18 in the interstices between the individual straws to facilitate their separation when the straws are dispensed.

When a flattened straw, for example straw 14 with its surrounding sheath formed of the connecting web 10, is separated from the other straws by tearing along the perforation 18, it is encased in its own protective sheath. The straw may then be removed from the sheath and used for drinking from a bottle, can carton, glass, cup or bowl.

The lateral sides 19 of the web 10 may be provided with sprocket holes, in the manner of computer paper, to facilitate handling.

The flattened drinking straw, which is preferably made of plastic, has a natural tendency to restore itself to its original, cylindrical shape. Once a straw has been dispensed, and the squeezing force has been removed, the straw will therefore expand toward this cylindrical shape. If necessary, an additional restoring force may be applied in the manner shown in FIG. 3 to restore the straw from its flattened configuration 20 to its cylindrical configuration 21.

Instead of using fingers, it is possible to provide a simple squeezing press which accomplishes the same result.

Depending upon the porosity of the web material, it is possible to maintain the straws in a flattened condition within their respective sheaths by vacuum packing the straws in the sheaths during the web assembly and packaging process. Notwithstanding such vacuum packing, or as an alternative, it is desirable to apply and maintain a squeezing force on the straws to assist in maintaining their flattened form during shipping and insertion in a dispensing device. Preferred embodiments of supply cartridges which maintain such a force will now be described below in connection with FIGS. 4–6.

Figure 4:
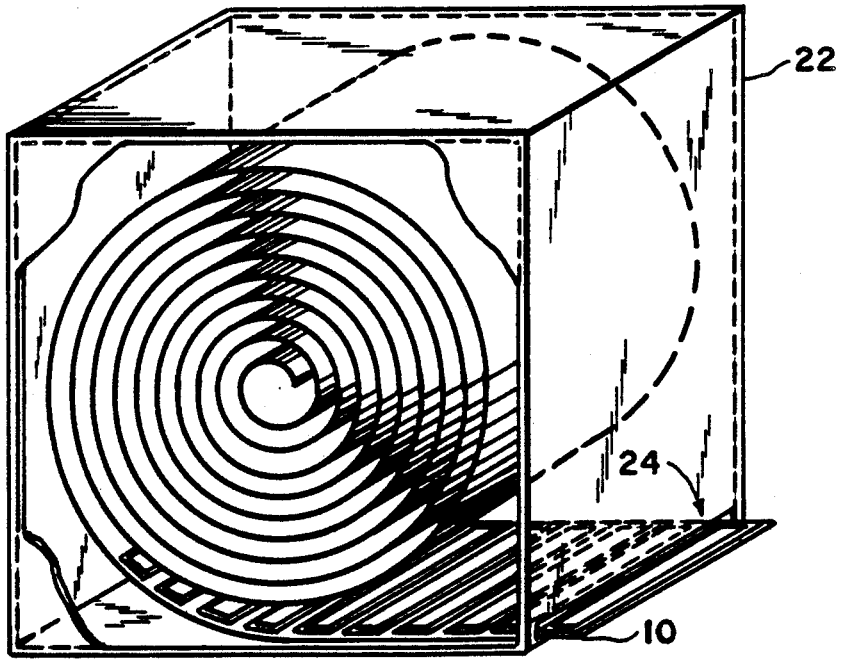
FIG. 4 is a perspective view, partially cut away, of a drinking straw supply cartridge in accordance with a first preferred embodiment of the present invention.

FIGS. 4, 5 and 6 illustrate three different supply cartridges in accordance with the present invention. As illustrated in FIG. 4, the web 10 is wound into a tight spiral to maintain the straws in their flattened shape. The spiral is inserted into a box-like container 22 made of semi-rigid material such as cardboard, plastic, metal or the like, and exits from a slot-like opening 24 on one side. The container 22 maintains the pressure on the spiral to prevent it from unwinding prematurely.

The slot-like opening 24 may be provided with a cutting edge to facilitate tearing off of each sheath, with its accompanying straws, from the remainder of the web.

FIG. 5 shows the web 10 arranged in zig-zag form within a similar box-like container 26. The container is sufficiently filled to cause a continued squeezing force to be applied to the web and to the flattened straws within it, while allowing sufficient slack to permit the web 10 to be "pulled" and the straws removed. As in the embodiment of the FIG. 4, the container 26 is provided with a slot-like opening 28 for removing the web and straws, with a cutting edge, if desired, to facilitate tearing off of each sheath.

The embodiment of FIG. 6 differs substantially from that of FIGS. 4 and 5 in that the individual flattened straws 30 are arranged in unconnected form within a container 32. These straws may be individually wrapped in protective sheathes, as shown, or they may be provided without a protective cover, as desired. Due to the large number of straws which are packed within the container 32, the straws are squeezed together to maintain their flattened shape, unless vacuum packed.

The straws 30 may be removed, one by one, from the container 32 by withdrawing them from an open front side 34 of the container, either by hand or by a dispensing device. As the straws are removed, the forces tending to flatten the straws are relieved so that, when the final straws are removed from the container, these straws will have restored themselves close to their original, cylindrical shape.

Figure 3:
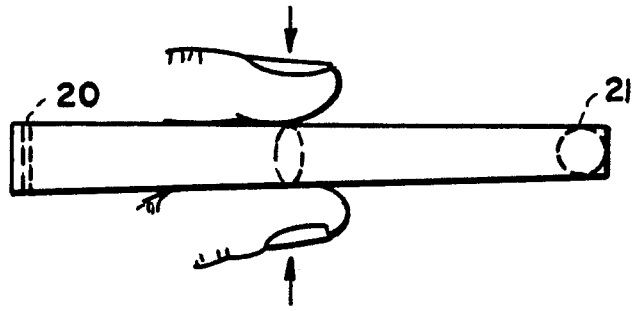
FIG. 3 is an elevational view illustrating how a flattened straw may be restored to its original, cylindrical shape by squeezing.

To the extent that the straws do not return to their original, cylindrical shape when the flattening forces are removed, they may be squeezed laterally in the manner illustrated in FIG. 3.

The supply cartridges shown in FIGS. 4, 5 and 6 are designed for shipment, storage and for conveniently dispensing the straws on site. Because the straws have been flattened to eliminate the air space inside, each supply cartridge holds at least 10 times the number of straws that would otherwise be supported if the straws were retained within the cartridge boxes in their original, cylindrical shape.

Figure 7:
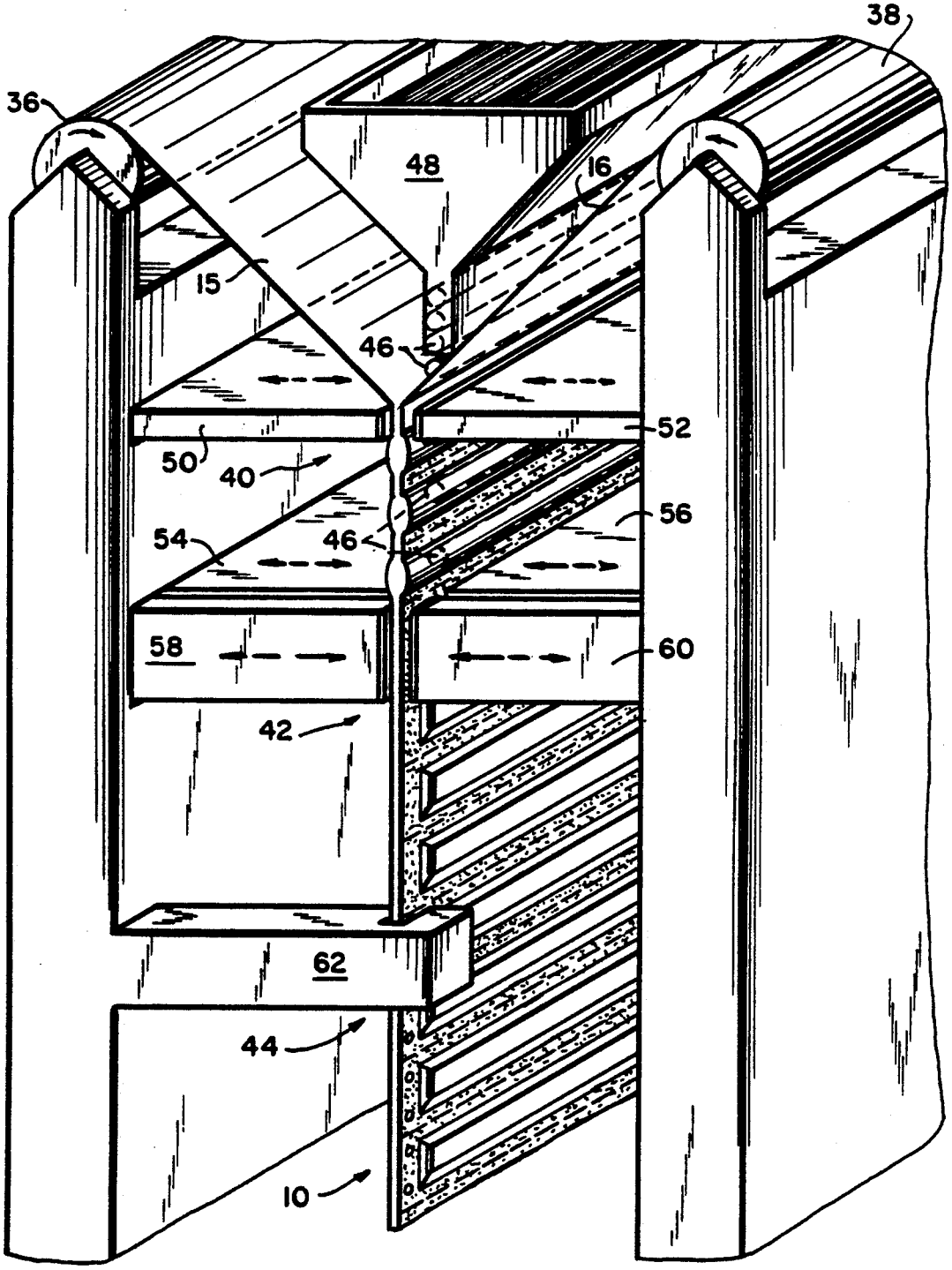
FIG. 7 is a perspective and representational diagram of a device for manufacturing the "straw strip" illustrated in FIGS. 1 and 2.

FIG. 7 illustrates a device for producing the endless "straw strip" 10 illustrated in FIGS. 1 and 2. As is shown, the individual webs 15 and 16 are supplied from rollers 36 and 38, respectively, and drawn downward in intermittent fashion through the device. The straw strip is formed in three stages indicated as 40, 42 and 44. In stage 40, straws 46 are released one by one from a hopper 48 and the two webs 15 and 16 are heat sealed and perferated between successive straws by reciprocating, and heated plungers 50 and 52. Thereafter, in stage 42 the straws are flattened by reciprocating plungers 54 and 56 and, after the air has been ejected, the web edges are heat sealed by reciprocating and heated plungers 58 and 60.

Finally, in stage 44, sprocket holes may be impressed along the lateral edges of the strip by a sprocket hole punch 62. The waste material punched out from the web may be removed in any convenient manner, for example by vacuum.

After manufacture, the web strip 10 may be rolled into a tightly wound spiral (FIG. 4) or passed back and forth in zig-zag fashion (FIG. 5) as desired.

FIGS. 8*a* and 8*b* show an alternative way of connecting straws together in parallel to facilitate dispensing from a spiral or zig-zag package. In this case, the straws 64 are held by two separate webs 66 and 68, respectively. Each web comprises two individual webs 70 and 72, on the top and bottom of the straws, respectively. After connecting the straws together they may be flattened into the shape shown in FIG. 8*b* by applying a force thereto at both top and bottom, and the web may be perferated between straws if desired.

The connecting arrangement shown in FIGS. 8*a* and 8*b* is slightly less expensive than the full web 10 of FIGS. 1 and 2; however, this arrangement does not provide a protective sheath for each individual straw.

There has thus been shown and described a novel supply arrangement and method for dispensing drinking straws, which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are intended to be covered by the claims which follow.

What is claimed is:

1. A supply arrangement for use in dispensing drinking straws, said arrangement comprising:

(a) A plurality of substantially flattened, flexible hollow tubes, each tube having a convenient length and cross-section for a drinking straw, said tubes being arranged substantially in parallel; and (b) means for pressing said tubes to maintain their flattened configuration along substantially their entire length.

2. The supply arrangement defined in claim 1, wherein all said tubes are of equal cross-section.

3. The supply arrangement defined in claim 1, wherein all said tubes are of equal length.

4. The supply arrangement defined in claim 1, wherein said pressing means includes package means surrounding said tubes for protecting said tubes from the environment.

5. The supply arrangement defined in claim 4, wherein said package mean is made of clear plastic.

6. The supply arrangement defined in claim 4, wherein said package means is a rigid container.

7. The supply arrangement defined in claim 1, further comprising flexible connecting means for connecting successive ones of said tubes in parallel, side-by-side arrangement.

8. The supply arrangement defined in claim 7, wherein said connecting means is spirally wound into a cylindrical shape.

9. The supply arrangement defined in claim 7, wherein said connecting means extends back and forth in zig-zag form.

10. The supply arrangement defined in claim 7, wherein said connecting means is a web of flexible material.

11. The supply arrangement defined in claim 10, wherein said web of material is a laminate of two individual webs, with said tubes sandwiched between said individual webs.

12. The supply arrangement defined in claim 11, wherein said web material completely encases said tubes.

13. The supply arrangement defined in claim 12, wherein said web material is transversely perforated to facilitate separation of each individual tube.

14. A method for providing drinking straws, said method comprising the steps of:

(a) providing a plurality of flexible, hollow, cylindrical tubes, each tube having a convenient length and cross-section for a drinking straw;

(b) arranging said tubes substantially in parallel; and (c) pressing said tubes to force them into a substantially flattened configuration along substantially their entire length.

15. The method defined in claim 14, wherein said pressing step includes the step of surrounding said tubes with a protective packaging.

* * * * *